US009562538B2

(12) United States Patent
Tian et al.

(10) Patent No.: US 9,562,538 B2
(45) Date of Patent: Feb. 7, 2017

(54) POWER SUPPLY CIRCUIT

(71) Applicant: ShenZhen Treasure City Technology Co., LTD., Shenzhen (CN)

(72) Inventors: Bo Tian, Shenzhen (CN); Kang Wu, Shenzhen (CN)

(73) Assignee: ShenZhen Treasure City Technology Co., LTD., ShenZhen (CN)

( * ) Notice: Subject to any disclaimer, the term of this patent is extended or adjusted under 35 U.S.C. 154(b) by 467 days.

(21) Appl. No.: 14/195,859

(22) Filed: Mar. 4, 2014

(65) Prior Publication Data

US 2014/0255213 A1 Sep. 11, 2014

(30) Foreign Application Priority Data

Mar. 7, 2013 (CN) ..... 2013 1 0728141

(51) Int. Cl.
*F04D 27/00* (2006.01)
*F04D 25/02* (2006.01)
*F04D 25/06* (2006.01)

(52) U.S. Cl.
CPC ..... *F04D 27/004* (2013.01); *F04D 25/02* (2013.01); *F04D 25/06* (2013.01); *F04D 25/068* (2013.01); *F04D 27/00* (2013.01)

(58) Field of Classification Search
CPC ..... G06F 1/20; G06F 1/203; Y10T 307/696; Y10T 307/702; Y10T 307/724; Y10T 307/729; Y10T 307/735
USPC ..... 361/679.48, 695; 307/80, 81, 85–87
See application file for complete search history.

(56) References Cited

U.S. PATENT DOCUMENTS

2009/0162039 A1* 6/2009 Zou ..... G06F 1/206 388/811
2009/0175602 A1* 7/2009 Qian ..... G06F 1/206 388/825
2014/0119882 A1* 5/2014 Chen ..... G06F 1/20 415/1
2014/0184126 A1* 7/2014 Zhou ..... H02P 7/29 318/503

* cited by examiner

*Primary Examiner* — Fritz M Fleming
(74) *Attorney, Agent, or Firm* — Zhigang Ma

(57) ABSTRACT

A power supply circuit includes a connector for a fan, a speed adjusting circuit, a speed feedback circuit, a control module, first and second power sources, and a switching module. The speed adjusting circuit is connected to a modulation pin of the connector. The speed feedback circuit is connected to a speed pin of the connector. The control module receives a speed signal from the fan through the speed feedback circuit and outputs signals correspondingly. The switching module selects the first or the second power source to supply power for the fan according to the signals from the control module.

8 Claims, 4 Drawing Sheets

POWER SUPPLY CIRCUIT

BACKGROUND

1. Technical Field

The present disclosure relates to a power supply circuit.

2. Description of Related Art

Fans are used for heat dissipation in a server. However, if the fans cannot get power, the fans stop operating, and the heat can damage the server.

Therefore, there is room for improvement in the art.

BRIEF DESCRIPTION OF THE DRAWINGS

Many aspects of the present disclosure can be better understood with reference to the following drawing(s). The components in the drawing(s) are not necessarily drawn to scale, the emphasis instead being placed upon clearly illustrating the principles of the present disclosure. Moreover, in the drawing(s), like reference numerals designate corresponding parts throughout the several views.

DETAILED DESCRIPTION

Figure 1:
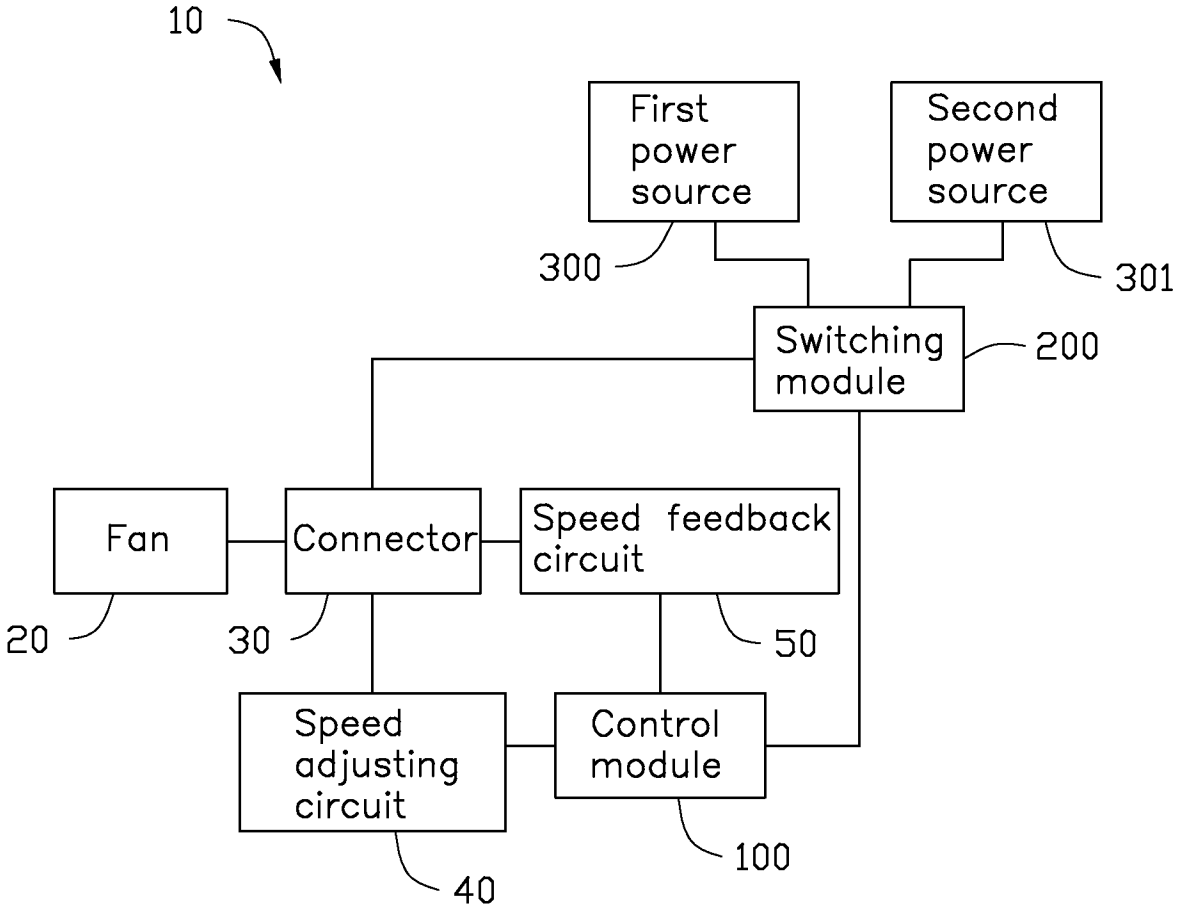
FIG. 1 is a block diagram of an embodiment of a power supply circuit.

Many aspects of the present disclosure can be better understood with reference to the following drawing(s). The components in the drawing(s) are not necessarily drawn to scale, the emphasis instead being placed upon clearly illustrating the principles of the present disclosure. Moreover, in the drawing(s), like reference numerals designate corresponding parts throughout the several views.

Figure 2:
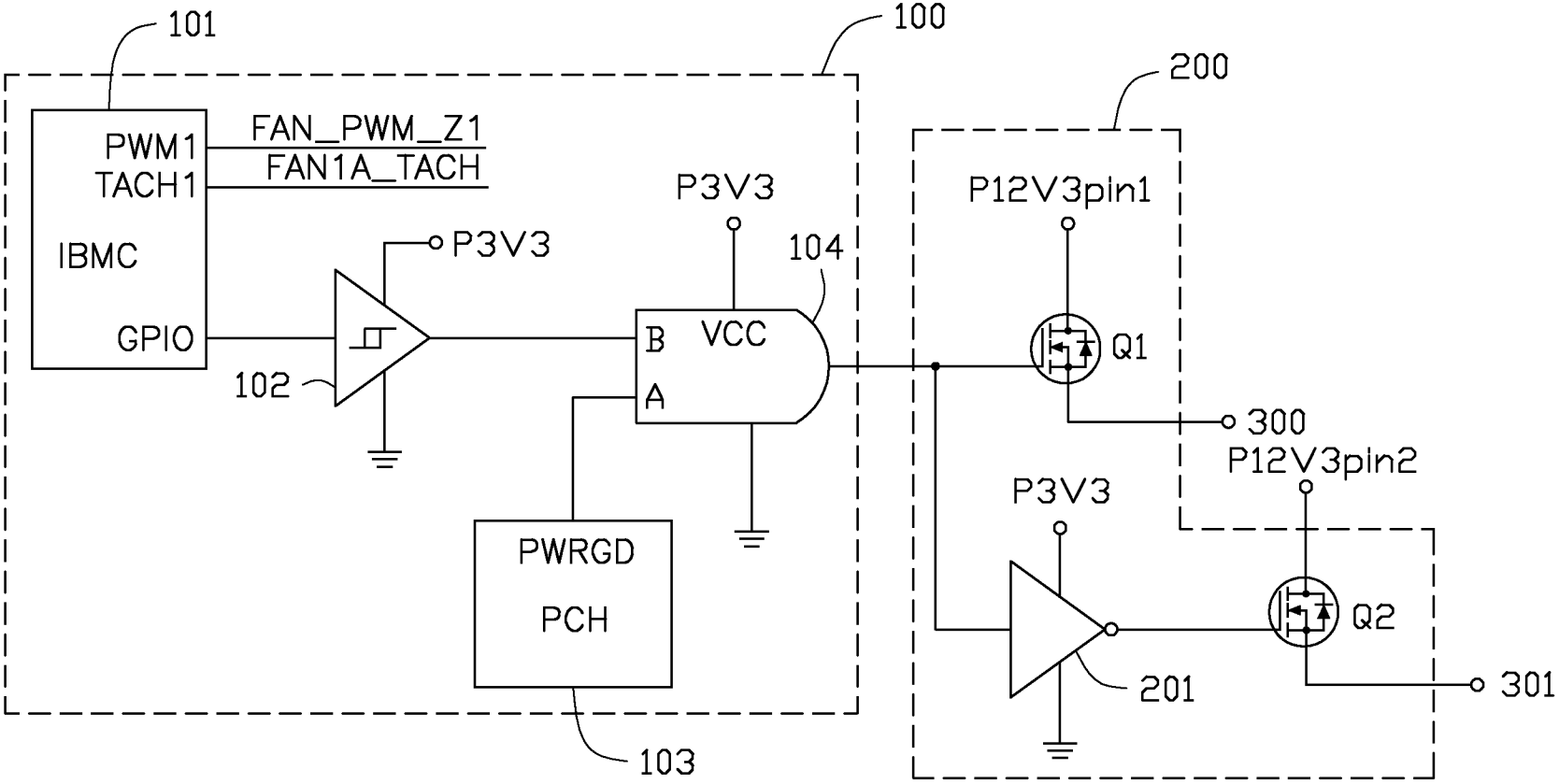
FIGS. 2-4 are circuit diagrams of the power supply circuit of FIG. 1.
Figure 3:
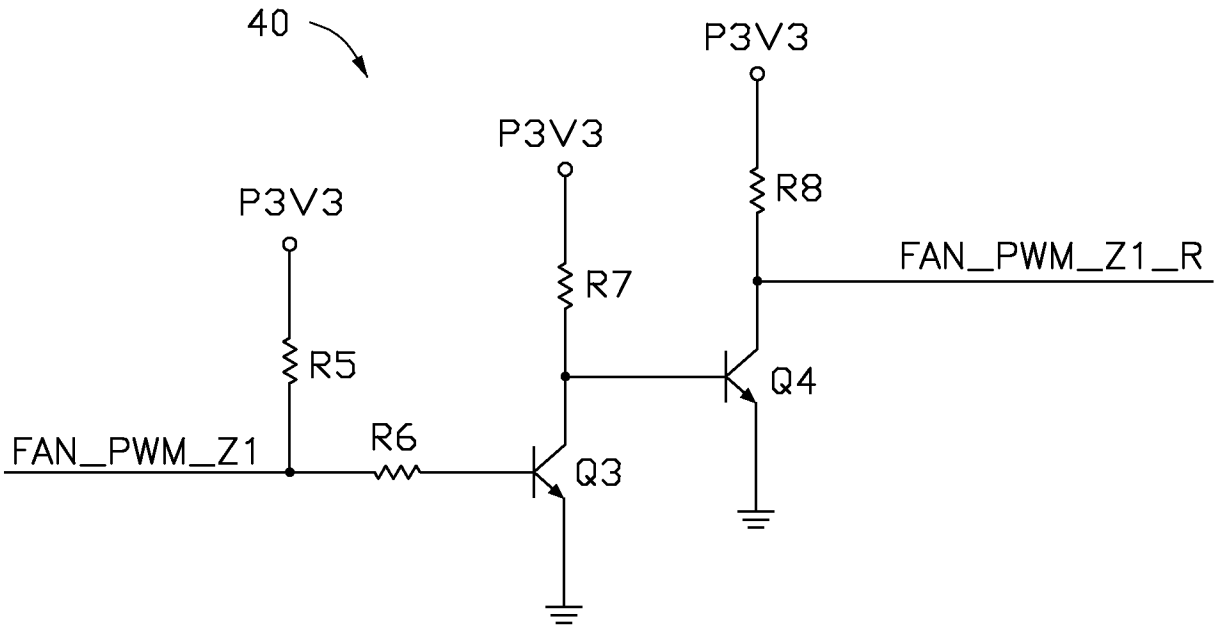
Figure 4:
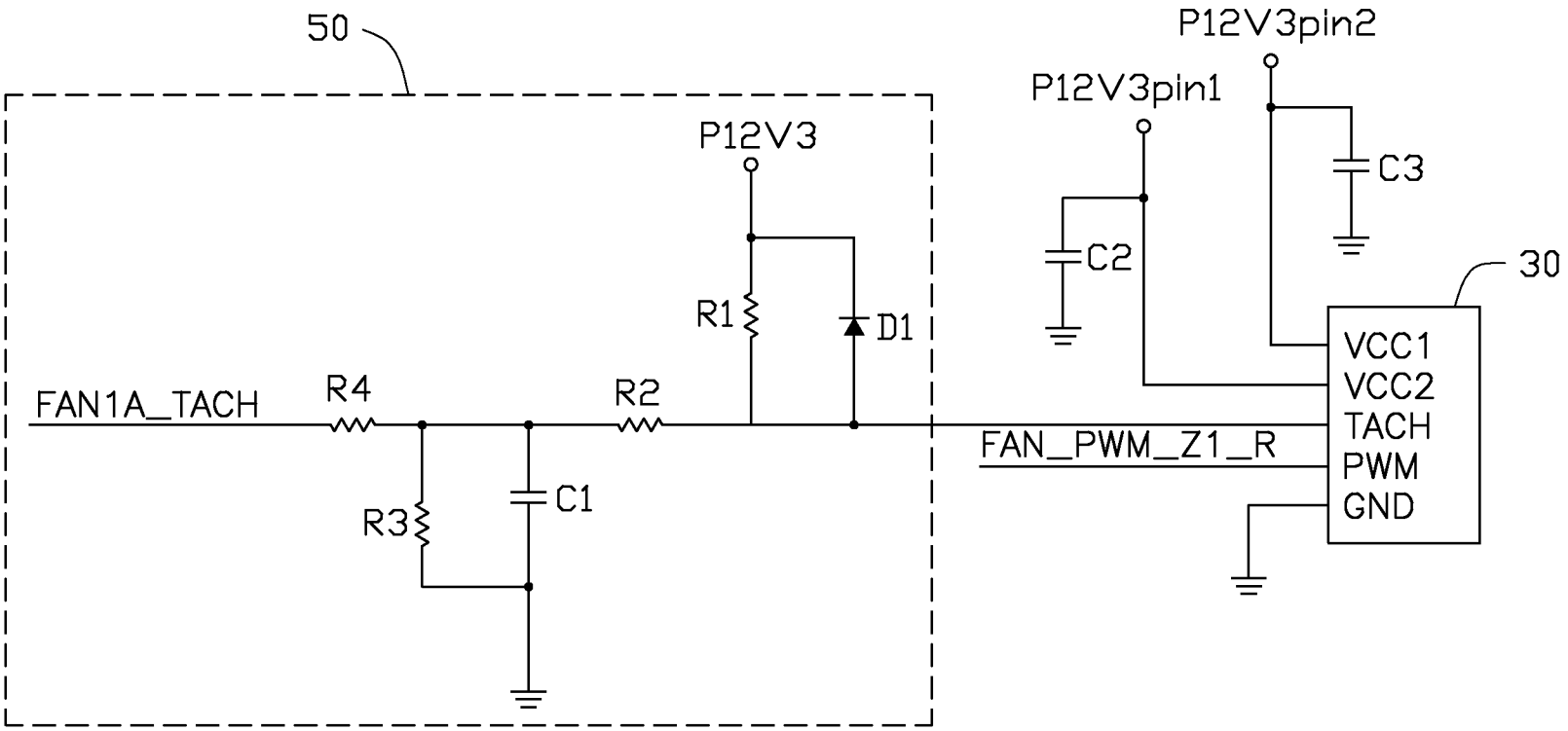

FIGS. 1-4 show an embodiment of a power supply circuit 10 of the present disclosure. The power supply circuit 10 supplies power for a fan 20 of a server.

The power supply circuit 10 comprises a connector 30, a speed adjusting circuit 40, a speed feedback circuit 50, a control module 100, a switching module 200, a first power source 300, and a second power source 301. The connector 30 is connected to the fan 20. The connector 30 comprises a speed pin TACH, a modulation pin PWM, a first power pin VCC1, a second power pin VCC2, and a ground pin GND.

The control module 100 comprises an integrated baseboard management controller (IBMC) 101, a Schmitt trigger 102, a platform controller hub (PCH) 103, and an AND gate 104. The IBMC 101 comprises a speed pin TACH1, a signal pin GPIO, and a modulation pin PWM1. The speed pin TACH1 receives speed signals of the fan 20 from the speed pin TACH of the connector 30 through the speed feedback circuit 50. The signal pin GPIO is connected to an input of the Schmitt trigger 102. An output of the Schmitt trigger 102 is connected to a first input B of the AND gate 104. The modulation pin PWM1 is connected to the modulation pin PWM of the connector 30 through the speed adjusting circuit 40.

A power good pin PWRGD of the PCH 103 is connected to a second input A of the AND gate 104. An output of the AND gate 104 is connected to the switching module 200. When the server starts to operate, the PCH 103 outputs high level signals, such as logic 1, through the power good pin PWRGD.

The switching module 200 comprises a first electronic switch Q1, a second electronic switch Q2, and an inverter 201.

A first terminal of the first electronic switch Q1 is connected to the output of the AND gate 104. A second terminal of the first electronic switch Q1 is connected to the first power source 300. A third terminal of the first electronic switch Q1 is connected to the first power pin VCC1 of the connector 30.

A first terminal of the second electronic switch Q2 is connected to an output of the inverter 201. A second terminal of the second electronic switch Q2 is connected to the second power source 301. A third terminal of the second electronic switch Q2 is connected to the second power pin VCC2 of the connector 30. An input of the inverter 201 is connected to the output of the AND gate 104.

In the embodiment, the first and second electronic switches Q1 and Q2 are n-channel metal-oxide-semiconductor field effect transistors (MOSFETs). The first terminals of the first and second electronic switches Q1 and Q2 are corresponding to gates of the MOSFETs. The second terminals of the first and second electronic switches Q1 and Q2 correspond to sources of the MOSFETs. The third terminals of the first and second electronic switches Q1 and Q2 correspond to drains of the MOSFETs.

The speed feedback circuit 50 comprises resistors R1-R4, a diode D1, a capacitor C1, and a power terminal P12V3. The power terminal P12V3 is connected to the speed pin TACH of the connector 30 through the resistor R1. The power terminal P12V3 is also connected to a cathode of the diode D1. An anode of the diode D1 is connected to the speed pin TACH of the connector 30. The speed pin TACH is connected to the speed pin TACH1 of the IBMC 101 through the resistors R2 and R4 in that order. A node between the resistors R2 and R4 is grounded through the capacitor C1. The resistor R3 and the capacitor C1 are connected in parallel.

The speed adjusting circuit 40 comprises resistors R5-R8, a Bipolar Junction Transistor (BJT) Q3 and a BJT Q4, and a power terminal P3V3. The modulation pin PWM1 of the IBMC 101 is connected to the power terminal P3V3 through the resistor R5. The modulation pin PWM1 of the IBMC 101 is also connected to a base of the BJT Q3 through the resistor R6. An emitter of the BJT Q3 is grounded. A collector of the BJT Q3 is connected to the power terminal P3V3 through the resistor R7. The collector of the BJT Q3 is also connected to a base of the BJT Q4. An emitter of the BJT Q4 is grounded. A collector Q4 is connected to the power terminal P3V3 through the resistor R8 and is also connected to the modulation pin PWM of the connector 30.

In the embodiment, the BJTs Q3 and Q4 are NPN BJTs.

When the server starts to operate, the IBMC 101 outputs a high level signal the first input B of the AND gate 104 through the Schmitt trigger 102. The PCH 103 outputs a high level signal to the second input A of the AND gate 104. The AND gate 104 outputs a high level signal to the first terminal of the first electronic switch Q1. The second terminal of the first electronic switch Q1 is connected to the third terminal of the first electronic switch Q1. The first power source 300 is connected to the fan 20. The IBMC 101 receives speed signals from the fan 20 through the speed feedback circuit 50. When a speed of fan 20 is not zero, the IBMC 101 outputs the high level signal continuously to keep the connection between the first power source 300 and the fan 20. The AND gate also outputs the high level signal to the input of the inverter 201. The inverter 201 outputs a low level signal, such as logic 0, to the first terminal of the second electronic switch Q2. The second terminal of the second electronic switch Q2 and the third terminal of the second electronic switch Q2 are disconnected. The second power source 301 is disconnected from the fan 20.

When the first power source 300 cannot supply power to the fan 20, the speed of the fan 20 is zero. The IBMC outputs a low level signal through the signal pin GPIO. The low level signal is output to the first input B of the AND gate 104 through the Schmitt trigger 102. The PCH 103 outputs the high level signal continuously to the second input B of the AND gate 104. The AND gate 104 outputs a low level signal to the first terminal of the first electronic Q1. The second terminal of the first electronic Q1 and the third terminal of the first electronic Q1 are disconnected. The first power source 300 is disconnected from the fan 20. The AND gate 104 also outputs the low level signal to the input of the inverter 201. The inverter 201 outputs a high level signal to the first terminal of the second electronic switch Q2. The second terminal of the second electronic switch Q2 is connected to the third terminal of the second electronic switch Q2. The fan 20 is connected to the second power source 301. The second power source 301 supplies power for the fan 20.

While the disclosure has been described by way of example and in terms of preferred embodiment, it is to be understood that the disclosure is not limited thereto. To the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. A power supply circuit for a fan, comprising:

a connector comprising a speed pin, a modulation pin, a first power pin, a second power pin, and a ground pin;

a control module connected to the fan to receive a speed signal of the fan and output signals corresponding to the speed signal;

a speed feedback circuit connected between the speed pin of the connector and the control module to transmit the speed signal of the fan to the control module;

a first power source and a second power source; and a switching module connected to the control module, wherein the switching module is connected between the first power source and the first power pin of the connector, the switching module is also connected between the second power source and the second power pin of the connector, and the switching module connects the first power source and the first power pin of the connector or the second power source and the second power pin of the connector according to the signals from the control module.

2. The power supply circuit of claim 1, further comprising a speed adjusting circuit connected between the modulation pin of the connector and the control module to adjust a speed of the fan.

3. The power supply circuit of claim 2, wherein the control module comprises an integrated baseboard management controller (IBMC), a platform controller hub (PCH), and an AND gate 104, the IBMC comprises a modulation pin, a speed pin, and a signal pin, the modulation pin of the IBMC is connected to the speed adjusting circuit, the speed pin of the IBMC is connected to the speed feedback circuit, the signal pin of the IBMC is connected to a first input of the and gate, the PCH comprises an output connected to a second input of the and gate, and the switching module is connected to an output of the AND gate.

4. The power supply circuit of claim 3, wherein the control module further comprises a Schmitt trigger, and the Schmitt trigger comprises an input connected to the signal pin of the IBMC and an output connected to the first input of the AND gate.

5. The power supply circuit of claim 4, wherein the switching module comprises a first electronic switch, a second electronic switch, and an inverter, each of the first and second electronic comprises first, second, and third terminals, the first terminal of the first electronic switch is connected to the output of the AND gate, the second terminal of the first electronic is connected to the first power source, the third terminal of the first electronic switch is connected to the first power pin of the connector, the first terminal of the second electronic switch is connected to the output of the inverter, the second terminal of the second electronic switch is connected to the second power source, the third terminal of the second electronic switch is connected to the second power pin of the connector, and the input of the inverter is connected to the output of the AND gate.

6. The power supply circuit of claim 5, wherein the first and second electronic switch are n channel metal-oxide-semiconductor field effect transistors (MOSFETs), the first terminals of the first and second electronic switches correspond to gates of the MOSFETs, the second terminals of the first and second electronic switches and are corresponding to sources of the MOSFETs, and the third terminals of the first and second electronic switches correspond to drains of the MOSFETs.

7. The power supply circuit of claim 6, wherein the speed adjusting circuit comprises first, second, third, and fourth resistors, first and second NPN Bipolar Junction Transistor (BJT), and a power terminal, the modulation pin of the IBMC is connected to the power terminal through the first resistor, the modulation pin of the IBMC is also connected to a base of the first NPN BJY transistor, an emitter of the first NPN BJT is grounded, a collector of the first NPN BJT is connected to the power terminal through the third resistor, the collector of the first NPN BJT is also connected to a base of the second NPN BJT, an emitter of the second NPN BJT is grounded, a collector of the second NPN BJT is connected to the power terminal through the fourth resistor, and the collector of the second NPN BJT is also connected to the modulation pin of the connector.

8. The power supply circuit of claim 6, wherein the speed feedback circuit comprises first, second, third, and fourth resistors, a diode, a capacitor, and a power terminal, the power terminal is connected to the speed pin of the connector through the first resistor, the power terminal is also connected to a cathode of the diode, the speed pin of the connector is connected to an anode of the diode, the speed pin of the connector is also connected to the speed pin of the IBMC through the second and fourth resistors in that order, a node between the second and fourth resistors is grounded through the capacitor, and the capacitor and the third resistor are connected in parallel.

* * * * *